US005116074A

United States Patent [19]

Peyre

[11] Patent Number: 5,116,074

[45] Date of Patent: May 26, 1992

[54] SAFETY SKI BINDING FOR THE RELEASABLE HOLDING OF A SKI BOOT

[75] Inventor: Henri Peyre, Saint Benin d'Azy, France

[73] Assignee: Look S.A., Fed. Rep. of Germany

[21] Appl. No.: 653,967

[22] Filed: Feb. 12, 1991

[30] Foreign Application Priority Data

Feb. 20, 1990 [DE] Fed. Rep. of Germany ..... 4005254

[51] Int. Cl.[5] ..... A63C 9/081

[52] U.S. Cl. ..... 280/618; 280/613; 280/617; 280/631; 280/633; 280/636

[58] Field of Search ..... 280/618, 617, 616, 607, 280/613, 626, 627, 631, 636, 633, 634, 635

[56] References Cited

U.S. PATENT DOCUMENTS 3,899,190 8/1975 Schweizer et al. ..... 280/613
3,931,982 1/1976 Kubelka ..... 280/613

FOREIGN PATENT DOCUMENTS 1943989 12/1977 Fed. Rep. of Germany ..... 280/636
2749904 5/1979 Fed. Rep. of Germany ..... 280/617
7726029 4/1977 France .

*Primary Examiner*—Andres Kashnikow
*Assistant Examiner*—Eric Culbreth
*Attorney, Agent, or Firm*—Evenson, Wands, Edwards, Lenahan & McKeown

[57] ABSTRACT

Two base parts, by means of a spring assembly acting between them, are braced against sides of a pin with a non-circular cross-section fixed to the ski which face away from one another, in such a manner that the base parts, which together can be swivelled around the pin, are pushed into a desired position and when leaving the desired position, are moved away from one another. The ski boot is held in a form-locking manner between coupling elements and a holding-down device on the base parts. The holding-down device supports itself on the pin in such a manner that, in the case of an upward movement, one base part is moved away from the pin as well as from the other base part.

22 Claims, 3 Drawing Sheets

SAFETY SKI BINDING FOR THE RELEASABLE HOLDING OF A SKI BOOT

BACKGROUND AND SUMMARY OF THE INVENTION

The invention relates to a safety ski binding for the releasable holding of a ski boot, having two base parts which together can be swivelled around a pin with a non-circular cross-section which is perpendicular to the top side of the ski and is fixed to the ski. The base parts are braced against the force of a prestressable spring assembly operating between them and in such a manner that they can be moved apart in the longitudinal direction of the boot. The base parts are braced by the spring assembly against opposite sides of the pin which, because of its non-circular cross-section, moves the base parts apart when they swivel from a normal position into an oblique position. Coupling elements are arranged on the base parts which interact with countercoupling elements fixed to the boot for the holding of the ski boot on the ski in a form-locking manner as well as essentially without play in the normal position of the base parts. The countercoupling elements of which, when the base parts are moved apart, release the ski boot. A holding-down device which is arranged on a base part as a coupling element and can be moved between a locked position and an engageable release position, in the direction of the vertical axis of the ski, during its movement into the release position, moves one base part away from the other base part against the resistance of the spring assembly which seeks to restore the base parts into the normal position and thus the holding-down device into the locked position. From the engaged release position, when the ski boot is placed in the binding the holding down device can be stepped down by a part of the ski boot while disengaging in the direction of the locked position. The holding-down device, in the normal position of the base parts, reaches from above over a countercoupling element. An actuating member is provided which is positively coupled with the holding-down device for its arbitrary operation.

A safety ski binding of this type is known from the French Patent Application 77 26029; compare particularly FIGS. 21 to 23 as well as the pertaining description.

In the case of this known ski binding, the holding-down device arranged on one base part has cams which interact with assigned connecting links on the other base part in such a manner that the two base parts, in the release position of the holding-down device, are held in a position in which they are moved away from one another by means of the cams as well as the connecting links paths. As a result, the spring assembly is prevented from pressing the base parts against the pin fixed to the ski; i.e., the frictional connection between the base parts and the pin which is normally caused by the spring assembly, is undone. In order to now avoid an undesirable play of the base parts relative to the pin, a separate detent piston is arranged on one base part which, by means of a separate spring, is pushed against a facing flattened side of the pin. In this manner, an actuating force can be generated which seeks to bring the base parts into a position in which the longitudinal axis of the base parts extends in parallel to the longitudinal axis of the ski and the base part opposite the piston is pushed against the side of the pin facing away from the piston.

This construction is relatively expensive. A large number of parts which are movable relative to one another cause a higher friction. In addition, the release resistance of the ski binding is not influenced solely by the prestressing of the spring assembly, but also by the tensioning of the additional spring acting upon the detent piston.

It is now an object of the invention to achieve, in the case of a ski binding of the initially mentioned type, a simplified construction as well as an improved handling.

According to the invention, this object is achieved by means of the fact that the holding-down device in its release position holds the one base part, against the force of the spring assembly, away from the pin fixed to the ski on which the holding device supports itself directly or indirectly during the process.

According to the invention, it is therefore provided that the holding-down device can interact directly with parts arranged on it or indirectly, by way of transmission parts, with the pin in order to move the base part carrying the holding-down device away from the pin. In this case, the spring assembly, which is clamped in between the two base parts and seeks to push these base parts against one another has the effect that the one base part carrying the holding-down device, by way of the holding-down device or the parts which are connected with it or interact with it, and the other base part remain pressed directly against the pin. Thus, the base parts remain held at the pin without play. In addition, a torque may possibly be generated which seeks to adjust the base parts into a desired alignment relative to the ski. For this purpose, it is only required that either the holding-down device or the parts connected with it or interacting with it or the other base part is held pressed against a non-circular surface of the pin by means of the spring assembly.

Because of the arrangement according to the invention, there is also the possibility to arrange similar holding-down devices on both base parts which, in their release position, hold the respective base part away from the pin.

According to a particularly preferred embodiment of the invention, it may be provided that a cam arranged at the holding-down device rests against one end of a tappet which is guided in the base part carrying the holding-down device so that it can be shifted radially with respect to the pin, and the other end of which is supported on the circumference of the pin. Thus a constructively simple possibility is provided to arrange the holding-down device at a larger distance from the pin in such a manner that the holding-down device can interact with the heel area of the ski boot - or with an area at the tip of the boot.

In addition, it is expedient for the base parts to form a plate which supports the ski boot perpendicularly, and for the countercoupling elements on the boot side to be designed as a plate part on the boot side. In this case, fixedly arranged vertical projections may be arranged on the base parts and interact with the longitudinal edges of the boot-side plate part and thus, in a form-locking manner, fix the boot in the transverse direction of the boot. In order to secure the boot in the longitudinal direction of the boot as well as against a lifting-off from the base parts, the edge of the boot-side plate part pointing to the tip of the boot may be embraced from the front and from above by a stationary claw or the like on one base part, while the edge of the plate part pointing to the heel of the ski boot is correspondingly embraced by the holding-down device. In this case, the holding down device, from its release position, may, when the ski boot is placed in the binding, be stepped down into the locking position by the heel area which projects over the boot-side plate part toward the rear.

In principle, a corresponding arrangement of the holding-down device is also possible on the tip of the boot.

Other objects, advantages and novel features of the present invention will become apparent from the following detailed description of the invention when considered in conjunction with the accompanying drawings.

DETAILED DESCRIPTION OF THE DRAWINGS

Figure 1:
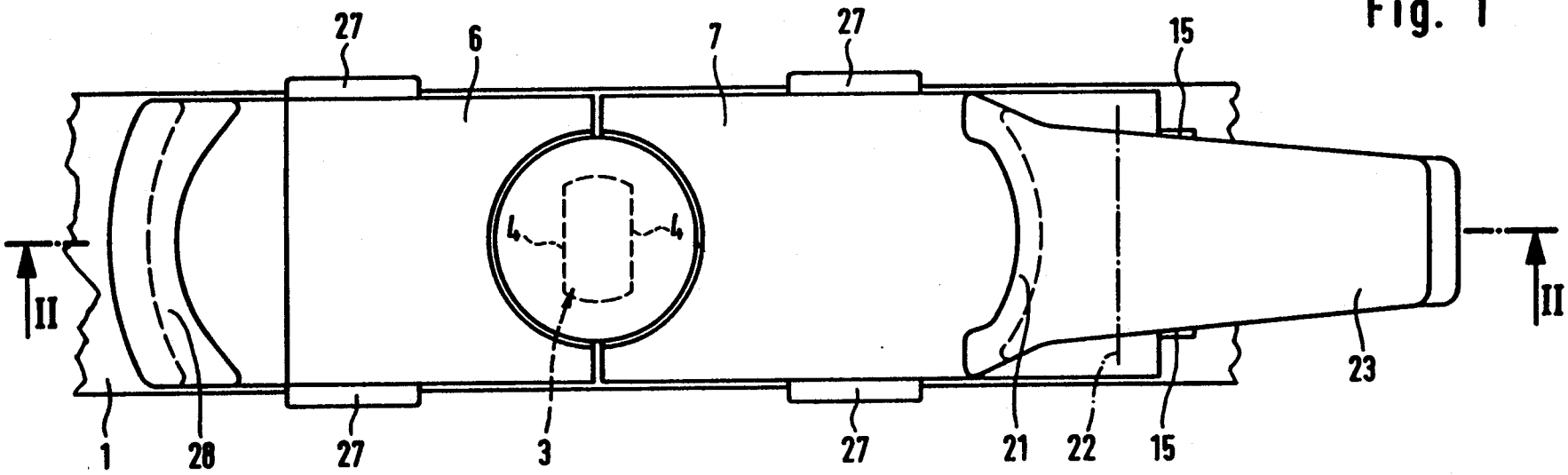
FIG. 1 is a top view of a ski binding constructed according to a preferred embodiment of the invention.

On the top side of a ski 1, a bearing plate 2 is fastened, for example, by means of screws not shown in the drawing. The edges of the bearing plate 2 facing the tip as well as the rear end of the ski, in top view, have a design in the shape of a circular arc, both circular arcs having the same curvature and the same center of curvature. In addition, the circular-arc-shaped edges of the bearing plate 2, in the manner shown in FIG. 2, in the form of steps, change into the center area of the bearing plate 2 in such a manner that the mentioned edges of the bearing plate 2 have a certain vertical distance from the top side of the ski 1.

On its top side, the bearing plate 2 carries a pin 3 that is perpendicular to the top side of the ski and is fixedly arranged in the center of curvature of the circular-arc-shaped edges of the bearing plate 2, this pin 3 having a cross-section which is non-circular in a pronounced manner and is equipped with a plate-like head. In this case, the pin, between the bearing plate 2 and its plate-like head, has two end faces 4 which face away from one another, are perpendicular with respect to the top side of the ski and parallel with respect to the transverse axis of the ski. Inside the end face 4 facing away from the tip of the ski, a slideway 5 is arranged which has two sections which are symmetrical with respect to the vertical longitudinal plane of the ski and are arranged in a wedge-shape at an obtuse angle relative to one another.

The bearing plate 2 as well as the pin 3 are used for the holding of two plate-type base parts 6 and 7. These base parts 6 and 7, by means of slide plates 8 on their bottom side, are slidably supported on the top side of the ski 1. In addition, recesses are arranged on the bottom side of the base parts 6 and 7 which are adapted to the circular-arc edges of the bearing plate 2 and which receive the circular-arc edges of the bearing plate 2, which are spaced away from the top side of the ski, in such a manner that the base parts 6 and 7 remain slidable in the longitudinal direction of the ski relative to the bearing plate 2 and, by means of webs 9 molded onto them, can reach under the circular-arc edges of the bearing plate 2 which are spaced away from the top side of the ski.

The top side of the base parts 6 and 7 is disposed at approximately the same plane as the top side of the plate-shaped head of the pin 3. In the surroundings of the pin, an indentation is developed in the top side of the base parts 6 and 7 in such a manner that the base parts 6 and 7 can reach under the plate-shaped head of the pin 3.

At the edges of the base parts 6 and 7 facing the pin 3, perpendicularly arranged plates 10 are held transversely with respect to the longitudinal axis of the base parts 6 and 7, which plates 10 form flat supporting surfaces interacting with the end faces 4 of the pin 3.

When the base parts 6 and 7 are made of plastic, which will be expedient as a rule, the plates 10 may be embedded in the material of the base parts 6 and 7.

The base parts 6 and 7 form a unit and, together, can be swivelled around the pin 3.

For the connection of the two base parts 6 and 7, two guide rods 11 are used which are parallel with respect to the longitudinal axis of the base parts 6 and 7 and the transverse distance of which is less than the diameter of the plate-shaped head of the pin 3. These guide rods 11, which extend between the plate-shaped head of the pin 3 and the bearing plate 2, penetrate bores in the plate 10 of the base part 6 and, at their ends which are on the left in FIG. 3, can be screwed tightly into corresponded threaded bores of the base part 6 by means of threaded sections arranged on them. The sections of the guide rods 11 which project out of the base part 6 in FIG. 3 toward the right penetrate bores in the plate 10 of the base part 7 as well as bores 12 connecting to it and arranged in the base part 7 which receive the guide rods 11 without play but in a slidingly displaceable manner. In a step-shaped manner, the bores 12 widen to bores 13 which extend to the edge of the base part 7 facing away from the pin 3.

Inside the bores 13, compression springs 14 are arranged which are axially penetrated by the guide rods 11 and which are clamped in under pressure between the step between the bores 12 and 13, on the one side, and threaded sleeves 15, on the other side, which can be adjusted in a screwed manner on threaded sections of the guide rods 11. The prestressing of the compression springs 14 can be adjusted by a corresponding screwed displacement of the threaded sleeves 15 on the guide rods 11.

Figure 3:
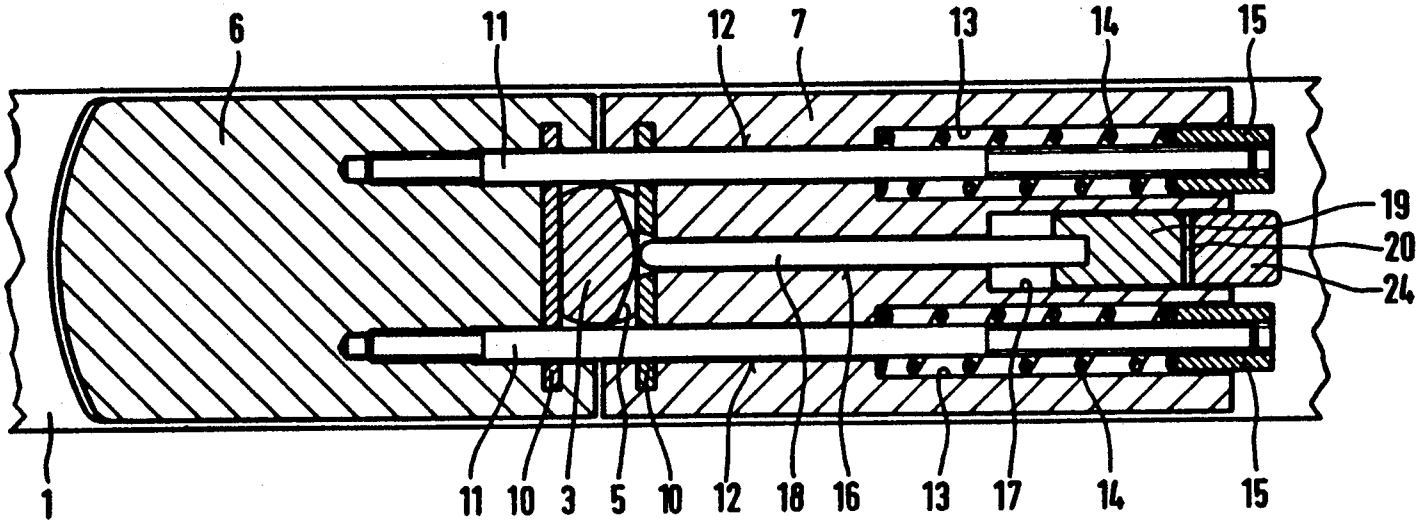
FIG. 3 is a horizontal sectional view corresponding to the section line III—III in FIG. 2.

The compression springs 14 seek to push the threaded sleeves 15, which are slidably received in the bores 13, toward the right relative to the base part 7 in FIG. 3. As a result, the base parts 6 and 7 are pressed with their plates 10 against opposite sides of the pin 3.

Between the two bores 12 and 13, another bore 16 is arranged at the level of the slideway 5 of the pin 3. Bore 16 is in parallel to the above-mentioned bores 12 and 13 and, through an opening in the plate 10 of the base part 7 is opened in the direction of the pin 3, and widens in FIG. 3 toward the right, in the manner of steps, in a duct 17 having a non-circular cross-section which is arranged in the base part 7.

In the bore 16, a tappet 18 is guided in a slidingly displaceable manner, the end of the tappet facing the pin 3 interacting with the slideway 5 and its other end, which projects into the duct 17, projecting into a thrust piece 19 which is slidably guided in the duct 17 and has a cross-section which is adapted to the non-circular cross-section of the duct 17, in such a manner that the thrust piece 19 is prevented from carrying out a rotation around the axis of the tappet 18.

The front face of the thrust piece 19, which faces away from the tappet 18, is constructed as an end face with a detent notch or detent step 20 extending in the transverse direction of the ski.

At the end of base part 7 which is away from the pin 3, a holding-down device 21 is disposed so that it can be swivelled around an axis 22 which is in parallel to the transverse axis of the base part 7. This holding-down device 21, together with an actuating lever 23, forms a double-lever-type part which is equipped with a downwardly projecting cam 24. This cam 24 projects through a slot-type recess on the base part 7 into the duct 17 where the cam 24 rests on the facing front face of the thrust piece 19.

Figure 2:
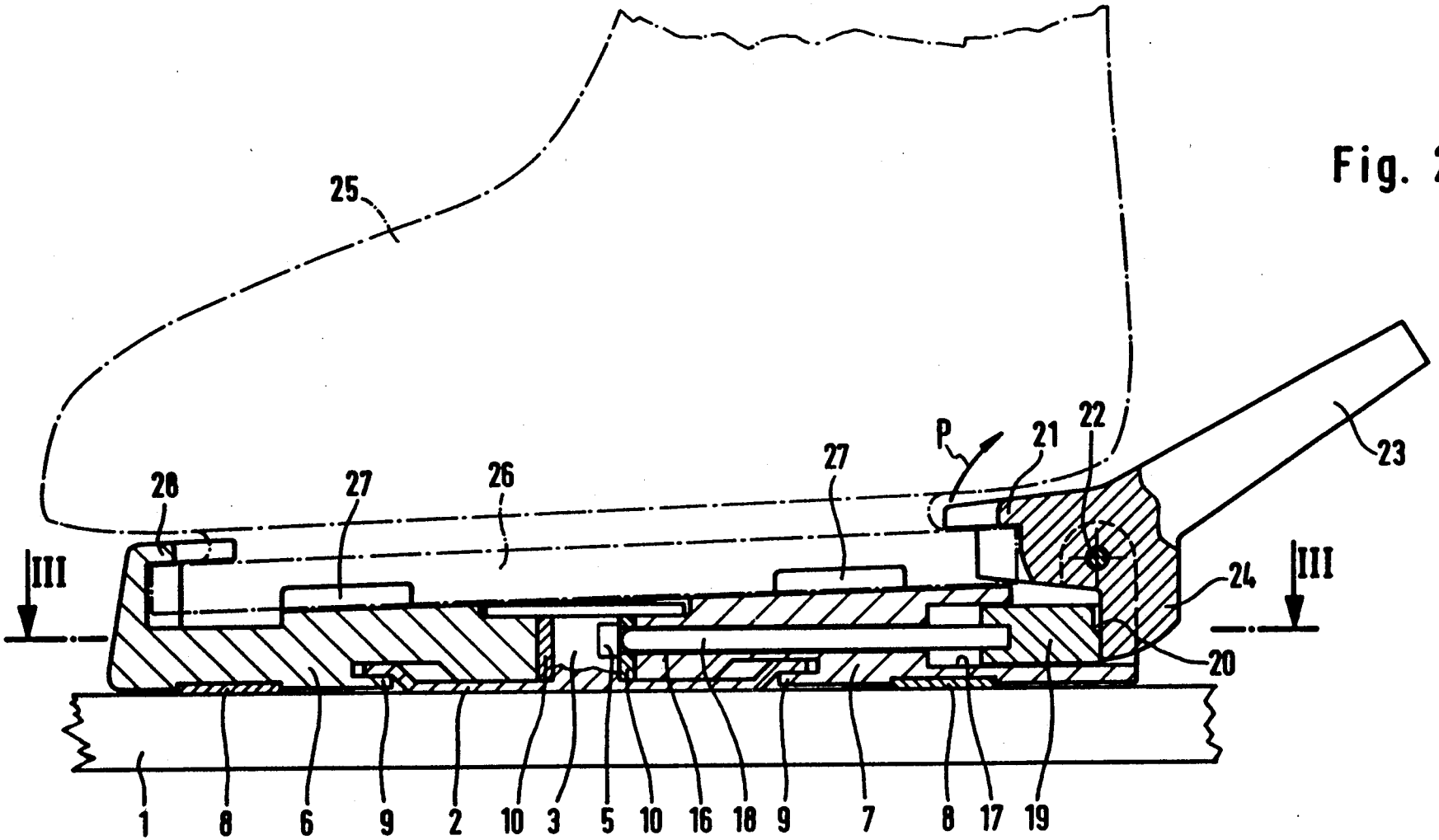
FIG. 2 is a longitudinal sectional view corresponding to the section line II—II in FIG. 1.

When the holding-down device 21 is adjusted from its locked position shown in FIG. 2 corresponding to the arrow P, into an upwardly swivelled release position, the cam 24 pushes the thrust piece 19 and therefore the tappet 18 toward the left relative to the base part 7, the pin-side end of the tappet 18 emerging from the assigned opening of the plate 10 of the base part 7 and pressing the base part 7 or its plate 10 away from the facing side of the pin 3 in a forced manner. When the release position is reached, the cam 24 engages in the detent notch or detent stop 20.

As soon as the holding-down device 21 has swivelled from the engaged release position slightly back into the direction of its locked position, the base part 7, together with its plate 10, is again moved toward the pin 3 because the compression springs 14 always seek to push the two base parts 6 and 7 against opposite sides of the pin 3. In this case, the tappet 18 as well as the thrust piece 19 are pushed toward the right relative to the base part 7 in FIG. 2, in which case the holding-down device 21 is restored in the locking position according to FIG. 2.

The shown binding is used for receiving a plate part 26 which is arranged on the underside of a ski boot 25 and which, in the shown normal position of the base parts 6 and 7, while the holding-down device 21 is in the locking position (compare FIG. 2), on the top side of the base parts 6 and 7, is held virtually without play by means of form-locking. The form-locking, on the one hand, is caused by supporting webs 27 which are arranged on the longitudinal edges of the base parts 6 and 7 and laterally reach over the longitudinal edges of the boot-side plate part 26. As a result, the plate part 26 is prevented from performing a rotation relative to the base parts 6 and 7 around an axis which is perpendicular to the top side of the base parts 6 and 7. On the other side, the front and rear transverse edges of the plate part 26 are held by a stop part 28, which is claw-shaped in its cross-section, on the end of the base part 6 away from the pin, and by the holding-down device 21 on the base part 7 so that they are largely immobile toward the front and toward the rear as well as upward, as shown in FIG. 2.

The illustrated binding operates as follows:

For the inserting of the ski boot 25 or of its plate part 26 into the binding, the holding-down device 21 is first brought into its upwardly swivelled release position by a stepping-down of its actuating lever, this release position remaining adjusted by the engaging of the cam 24 in the detent notch or the detent step 20 of the thrust piece 19. In this position of the holding-down device 21, the base part 7 is held away from the pin 3 by the tappet 18. In this case, the plate 10 of the base part 6 is braced with respect to the facing end face 4 of the pin 3 with the result that base part 6 as well as base part 7 align themselves with their longitudinal axes in parallel to the longitudinal axis of the ski 1 and seek to maintain this alignment. In this case, the pin-side end of the tappet 18 rests on the rounded-off wedge tip of the slideways 5.

Now the plate part 26 is inserted between the supporting webs 27 as well as the stop part 28 and the holding-down device 21. This is possible without any force because the base part 7 is kept away from the pin 3 and therefore also from the base part 6. Then, by means of the heel area of the ski boot 25 which projects toward the rear beyond the plate part 26, the holding-down device 21 can be stepped down from the release position swivelled in the direction of the arrow P, in which case the cam 24 is lifted out of the detent engagement with the detent notch or detent step 20 at the thrust piece 19. This disengaging has the result that the compression springs 14 can push the base parts 6 and 7 against one another as well as against opposite sides of the pin 3, until the position illustrated in FIGS. 1 to 3 has been reached.

For removing the boot out of the binding, it is sufficient to push down the actuating lever 23, whereby the base part 7 is moved away from the pin 3 as well as from the base part 6 so that the plate part 26 of the ski boot 25 can be lifted off base parts 6 and 7.

If a skier falls toward the front, the ski boot 25 seeks to lift itself off the base part 7 by its heel area (above the holding-down device 21). In this case, the rear end of the plate part 26 takes along the holding-down device 21 in the direction of the arrow P. If the forces are sufficiently high, the holding-down device 21 is swivelled so far into the direction of the arrow P—while at the same time the base part 7 is moved away from the pin 3 as well as from the base part 6—that the holding-down device 21 is no longer able to hold the plate part 26. Thus, the ski boot 25 is released from the binding.

In the case of strong torques relative to the axis of the tibia of the skier's leg, the ski boot 25 seeks to turn around the axis of the pin 3, in which case the base parts 6 and 7 come along in the rotation by the interaction of the supporting webs 27 with the longitudinal edges of the plate part 26. This has the result that the plates 10 of the base parts 6 and 7 which previously were flatly placed on the end faces 4 of the pin 3, take on an oblique position with respect to the end faces 4 and can each support themselves only on diametrically opposite vertical edges of the end faces 4. As a result, the plates 10 as well as the base parts 6 and 7 are moved away from one another, specifically in the case of a sufficiently wide swivelling of the base parts 6 and 7 around the pin 3 to such an extent that the stop part 28 as well as the holding-down device 21 can no longer simultaneously from above overlap the rear and the front ends of the plate part 26. Thus, the ski boot 25 is released again.

The last-described release is also facilitated by the fact that the end of the tappet 18 on the pin side, when the base parts 6 and 7 are swivelled around the pin 3, because of the shape of the slideway 5 on the pin 3, can increasingly emerge from the assigned opening of the plate 10 of the base part 7, and the holding-down device 21 obtains a corresponding clearance of motion in the direction of the arrow P.

In this manner, an overstraining of the foot and leg joint is counteracted in the case of so-called combined falls; i.e., in the case of a forward fall with simultaneous torsional strain to the skier's tibia.

Deviating from the embodiment illustrated in the drawing, a similar holding-down device 21 as on the base part 7 may be arranged on the base part 6, instead of the stop part 28. In this case the tappet 18 and the thrust piece 19 are then also arranged correspondingly. This also permits a release in the case of exclusive backward falls.

Figure 2A:
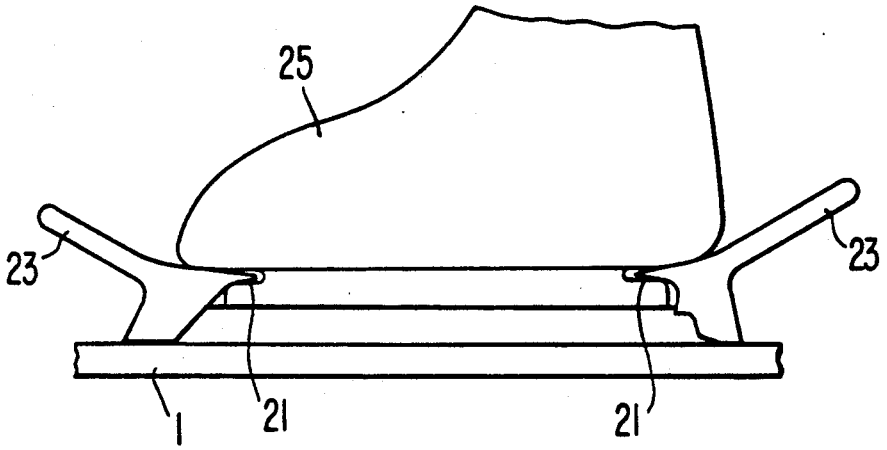
FIG. 2A is a schematic side view showing an alternative embodiment with releasable hold down devices at both ends of the ski boot.

FIG. 2A schematically depicts such an arrangement with hold down devices at both ends of the boot.

Alternatively, a release in the case of exclusive backward falls may also be permitted because of the fact that the stop part 28 reaches over the top part of the boot-side plate part 26 by means of an oblique surface which rises toward the pin 3. If then the tip of the boot is lifted off the base part 6 at a higher force, a force component in the longitudinal direction of the base part 6 will occur on the mentioned oblique surface, this base part 6 then trying to increasingly move away from the base part 7.

The detent-locking-type interaction of the cam 24 and the thrust piece 19 may also be achieved in that the cam 24, in the release position of the holding-down device 21, takes on an over-dead-center position in such a manner that the pressure of the thrust piece 19 acting upon the cam 24 seeks to move the holding-down device 21 in the direction of the arrow P beyond the release position developed as an end position. In this case, the arrangement of the detent notch or detent step 20 on the thrust piece 19 is not necessary.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A safety ski binding for releasably holding a ski boot at a ski, comprising:

a release pin fixedly disposable on a ski to extend perpendicularly upward from a top ski surface, a front base part having coupling means engageable with countercoupling means on a ski boot to hold the ski boot in position on the front base part, a rear base part having coupling means engageable with countercoupling means on a ski boot to hold the ski boot in position on the rear base part, elastic base part clamping means for elastically holding the front and rear base parts in an in-use ski boot holding position with engagement of the front and rear base parts at respective support surfaces of the release pin while permitting rotative movement of the base parts around the release pin to release the ski boot in response to predetermined forces thereon, hold down means selectively movable between a ski boot holding position and a ski boot release position for accommodating ski boot attachment and release by a skier, and base part release means for holding one of the base parts away from the release pin against the force of the elastic base part clamping means when said hold down means is in its ski boot release position to thereby maintain said base parts in relative positions permitting insertion of a ski boot into the respective coupling means.

2. A safety ski binding according to claim 1, wherein said hold down means includes upwardly facing ski boot abutment means which are engageable by a skier's boot to accomplish skier step-in movement of the hold down means from its ski boot release position to its ski boot holding position.

3. A safety ski binding according to claim 2, wherein said hold down means includes a coupling part which force lockingly engages a countercoupling part of a ski boot when in said ski boot holding position.

4. A safety ski binding according to claim 3, wherein said release pin exhibits a non-circular cross-section.

5. A safety ski binding according to claim 4, wherein said elastic base part clamping means includes prestressable compression spring means.

6. A safety ski binding according to claim 1, wherein the hold down means is constructed as a hold down lever which can be swivelled around an axis that is approximately in parallel to a top surface of a ski when in an in-use position on a ski.

7. A safety ski binding according to claim 6, wherein the hold down means and a skier actuable actuating member form a double lever.

8. A safety ski binding according to claim 6, wherein said base part release means includes cam means interposed between the hold down lever and the release pin.

9. A safety ski binding according to claim 8, wherein said base part release means includes a tappet member which is guided in one of the front and rear base parts so that it can be displaced radially with respect to the release pin, one end of said tappet means abuttingly engaging the cam means and the other end of said tappet member abuttingly engaging the release pin.

10. A safety ski binding according to claim 9, wherein one of said base parts includes a slideway extending substantially transversely at its support surface, and wherein said tappet member engages with said slideway.

11. A safety ski binding according to claim 9, wherein detent indentation means are disposed at the end of the tappet member opposite the release pin, said detent indentation means being engageable with the hold down lever to lock the base parts in said release position when the hold down lever is in its release position.

12. A safety ski binding according to claim 11, wherein said detent indentation means is disposed on a part which is guided to be non-rotatably moved along the longitudinal axis of the tappet member.

13. A safety ski binding according to claim 8, wherein said cam means is held in an over-dead-center position by the elastic base part clamping means when the hold down lever is in its release position.

14. A safety ski binding according to claim 1, wherein guide rods which are fixedly arranged on one of said base parts are longitudinally displaceably guided in the other base part, wherein the guide rods axially penetrate respective compression springs of the elastic base part clamping means, said compression springs being each clamped in between abutment parts on the guide rod and on the other base part.

15. A safety ski binding according to claim 14, comprising a threaded connection for adjusting the position of the rod-side abutment parts in such a manner that the compressive tension of the compression springs can be changed.

16. A safety ski binding according to claim 14, wherein the rod-side abutment parts are fixedly connected with the respective guide rods, and wherein the guide rods are arranged by means of threaded sections in threaded bores on one base part so that they can be adjusted by screwing, in such a manner that the compressive tension of the compression springs can be changed.

17. A safety ski binding according to claim 1, wherein the base parts form a plate which perpendicularly supports the ski boot when in an in-use skiing position.

18. A safety ski binding according to claim 1, wherein the boot-side countercoupling means are formed by a boot-side plate part, the edge of which interacts with the base part coupling means and with the hold down means, and wherein the hold down means as well as a plate side coupling element which is diametrically opposite the boot-side plate part is able to reach over the edge of the boot-side plate part from above.

19. A safety ski binding according to claim 18, wherein the boot-side plate part, in top view, is smaller than the ski boot, and wherein the ski boot projects over the boot-side plate part at least in the area of the hold down means in such a manner that the hold down means is forcibly stepped down from the release position into the direction of the locking position by the part of the ski boot projecting over it, when the binding is entered.

20. A safety ski binding according to claim 1, wherein the hold down means is arranged under the heel of the ski boot.

21. A safety ski binding according to claim 1, wherein the hold down means includes two functionally identical hold down devices which are applied respectively under a heel and a toe section of a ski boot.

22. A safety ski binding according to claim 1, wherein one of the hold down means and the parts supporting the hold down means on the release pin interact with a pin-side slideway which is shaped in such a manner that the locking position of the hold down means, when the base parts are swivelled out of a normal skiing position, is supported with increasing play.

* * * * *